United States Patent [19]

Halter

[11] 3,941,206

[45] Mar. 2, 1976

[54] NOISE ATTENUATING SNUBBER

[75] Inventor: Edmund John Halter, Irving, Tex.

[73] Assignee: Burgess Industries Incorporated, Dallas, Tex.

[22] Filed: May 8, 1974

[21] Appl. No.: 468,188

[52] U.S. Cl. ..... 181/50; 181/42

[51] Int. Cl.[2] ..... F01N 1/10

[58] Field of Search ..... 181/36 C, 41–42, 181/45, 47, 50, 57

[56] References Cited

UNITED STATES PATENTS

| | | | |
|---|---|---|---|
| 1,995,071 | 3/1935 | McKenzie | 181/42 |
| 2,652,899 | 9/1953 | Walton et al. | 181/42 |
| 2,824,619 | 2/1958 | Bremer et al. | 181/42 |
| 2,834,425 | 5/1958 | Rawson | 181/42 |
| 2,937,707 | 5/1960 | Ernst | 181/42 |
| 3,166,382 | 1/1965 | Purse et al. | 181/36 C |
| 3,735,567 | 5/1973 | Viers | 181/36 C |
| 3,744,589 | 7/1973 | Mellin | 181/58 |

FOREIGN PATENTS OR APPLICATIONS

| | | | |
|---|---|---|---|
| 1,031,055 | 9/1958 | Germany | 181/42 |

*Primary Examiner*—L. T. Hix
*Assistant Examiner*—Vit W. Miska
*Attorney, Agent, or Firm*—Darbo, Robertson & Vandenburgh

[57] ABSTRACT

The pulsating gas flow tube is open to the surrounding acoustic surge chamber through a relatively large opening at the inlet end of the snubber and perforations in the tube, and the chamber is filled with acoustically penetrable media which broadens the frequency range over which the chamber is acoustically effective. To handle moisture-laden gases without loss of acoustical efficiency, a coalescing element is provided to collect and remove moisture and prevent the accumulation thereof in the media.

5 Claims, 4 Drawing Figures

10
2
6
16
11
15
4
4
12
12
4
4a
1
14
13
13
5

NOISE ATTENUATING SNUBBER

BACKGROUND AND SUMMARY OF THE INVENTION

A wide variety of mufflers, silencers and snubbers have been devised to minimize the noise otherwise resulting from the direct exposure of pulsating flowing gases to the atmosphere. The treatment of such gas streams is limited by the necessity of avoiding adverse effects on the apparatus into which or from which the streams flow. The apparatus of U.S. Pat. No. 2,562,101 is an example of a reasonably effective unit which, by reason of the straight-through flow path of the gas stream, creates a minimum of resistance to the flow so that the effect on the operation and efficiency of the equipment involved is minimal. Because the effectiveness of this type of snubber depends upon the length of the snubbing chamber with respect to the frequency of the sound to be absorbed, it should be designed, for greatest efficiency, to meet the requirements of the frequency content of a particular application. Better sound absorbing operation is obtained when this length is one-quarter of the wave length of the sound to be attenuated and poorest performance results when this length is one-half of the wave length of the sound. Thus, a particular unit is somewhat selective and limited performancewise.

The object of the present invention is to provide a noise attenuating snubber of the type described which, for a given unit, is effective over a broader range of sound frequencies. More specifically, the object is to provide such apparatus wherein the snubbing or surge chamber is filled with acoustically penetrable media and the gas flow communication with the chamber is provided by a relatively large opening at the upstream end thereof and by the perforations of the gas flow tube which interiorly defines the chamber to achieve a noise attenuating unit which is effective over a relatively broad range of frequencies.

A further object is to provide means for removing entrained moisture from the gases which flow into the surge chamber in order to maintain the acoustic effectiveness of the media and thus of the chamber and unit.

DESCRIPTION OF SPECIFIC EMBODIMENT

Figure 1:
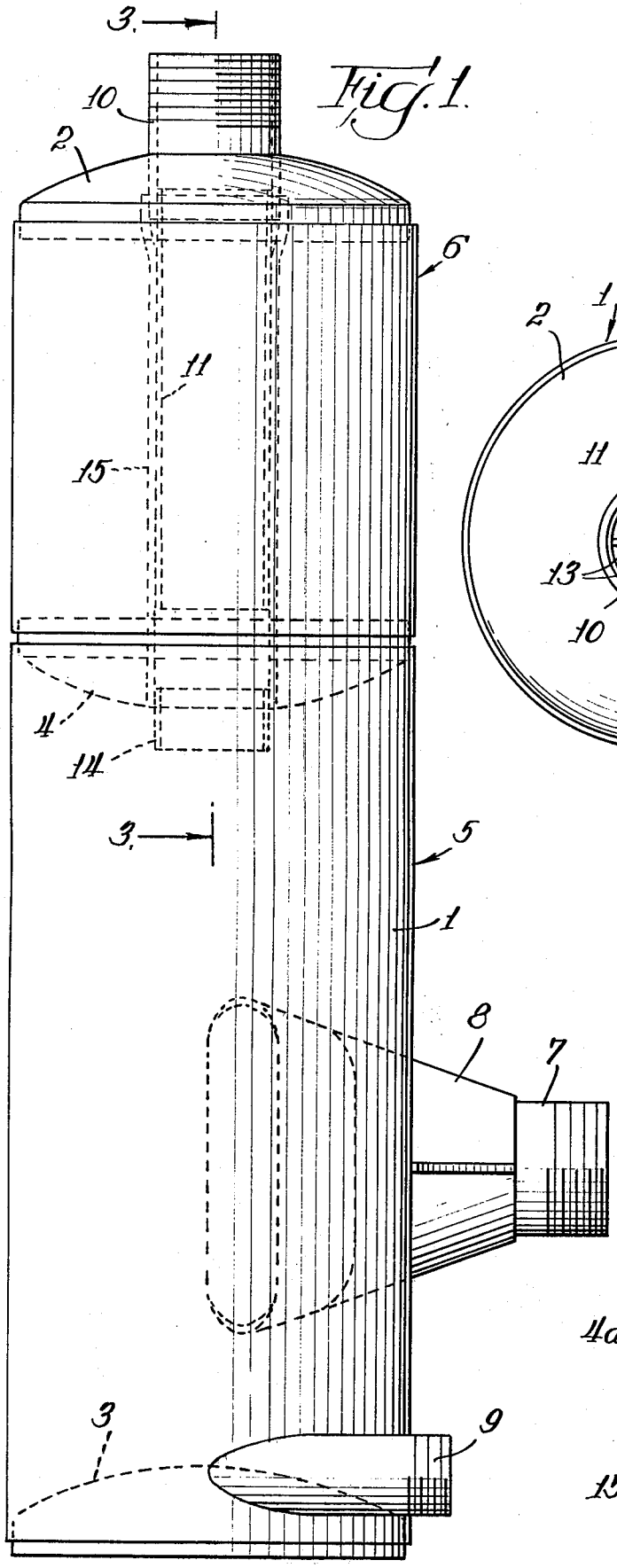
FIG. 1 is an elevational view of the noise attenuating snubber with an entrained liquid separator combined therewith.
Figure 2:
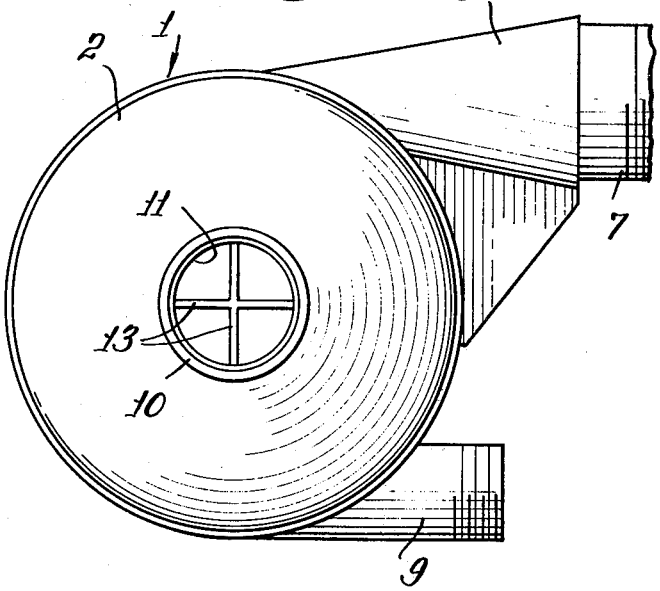
FIG. 2 is a top view of the unit of FIG. 1.
Figure 4:
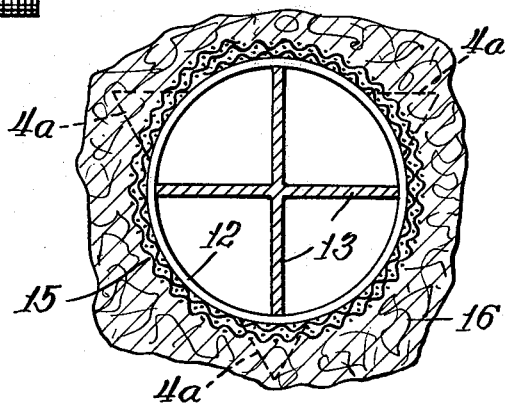
FIG. 4 is a cross-sectional view taken at the line 4–4 of the FIG. 3.
Figure 3:
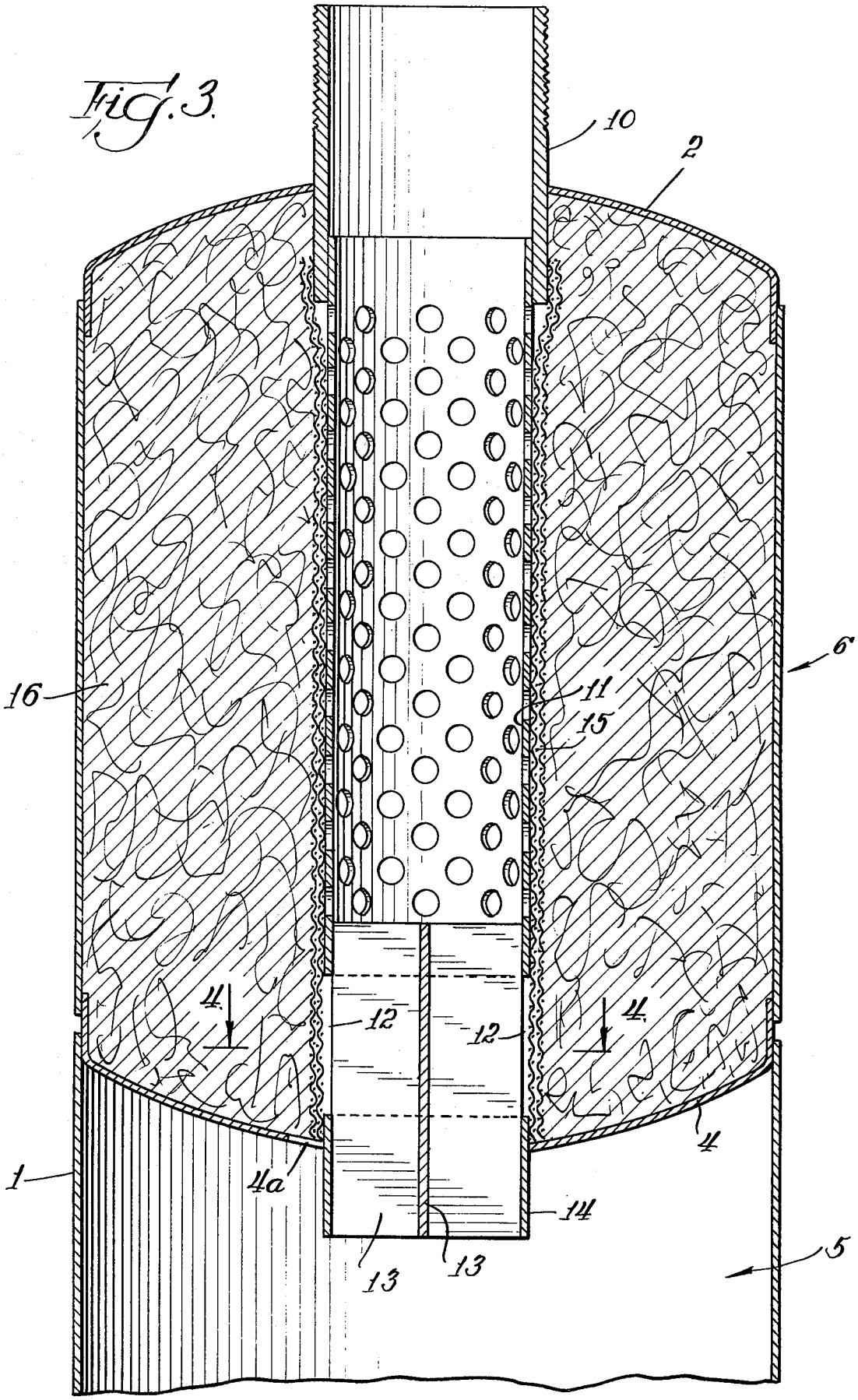
FIG. 3 is a cross-sectional view of the snubber section of the unit of FIG. 1.

Although the noise attenuating snubber may be used as a unit for silencing the exhaust, for example, of reciprocating engines, rotary blowers, vacuum pumps, compressors and the like, it provides very statisfactory service in the silencing of the discharge of wet vacuum pumps. Since the latter requires separation and removal of liquid particles entrained with the flowing gases, a combined separator and snubber is illustrated in the drawings and described as a specific embodiment of the invention.

A cylindrical housing 1 is closed at its top and bottom by walls 2 and 3, respectively. A partition 4 divides the interior of the housing into a separating chamber 5 and a snubber section 6. The inlet comprises a threaded snout 7 and flattened tangential horn 8 which is designed to cause the inflowing gas stream to swirl around the interior of the housing to throw entrained liquid particles against the surface of the housing. A liquid drain tube 9 is provided at the bottom of the unit.

Top wall 2 and partition 4 have openings at their centers for the passage of the gas stream through the snubber section. A threaded outlet snout 10 extends through the opening in wall 2 and is affixed thereto. A perforated gas flow tube 11 extends from snout 10 to a point short of partition 4, leaving a gap 12. A gas flow straightening vane assembly including vanes 13 and a short length of tube 14 is mounted in and between the opening in partition 4 and the inlet end of gas flow tube 11.

The perforated gas flow tube 11 and gap 12 are covered by two layers 15 of stainless steel mesh wire cloth. The acoustic surge chamber 16 surrounding the wire cloth within the housing is filled with an acoustically penetrable media such as unoriented glass fiber.

For best results, optimum design criteria should be followed. Preferably, the area of gap 12 should be approximately four times the cross-sectional area of tube 11 and the total area of the perforations of the tube 11 should be about two times the cross-sectional area of the tube. The dimensions of the wire cloth 15 are not critical; 18 × 18 stainless steel mesh, wire diameter 0.009 inches, is satisfactory. The glass fiber media may be packed to a density of approximately 10.5 pounds per cubic foot although good results have been obtained with densities in the range of 5 to 15 pounds per cubic foot.

The size of silencing equipment is important both from the standpoint of valuable space occupied by the apparatus and also the cost of the unit. Since the speed of sound in the media packed snubbing chamber 16 is substantially less than that of the empty chamber, the acoustical effect of packing is equivalent to the lengthening of the chamber. More important, it has been found that the range of frequencies attenuated by the action of the acoustic surge chamber is substantially broadened by the presence of the acoustically penetrable media.

In the operation of the apparatus described, the inlet snout 7 is connected to the outlet conduit of the apparatus which is the gas stream noise source. After treatment in the separating chamber, the gases flow into the snubber section through tube 14 and the flow straightening vanes as a succession of high-pressure surges or slugs separated by intervening stretches of low pressure. The slugs, which comprise masses of gas under high pressure, expand through gap 12 into the media-packed acoustic surge chamber 16. As these gases flow through the media, the velocity, pressure and kinetic energy are greatly reduced and dissipated. A portion of the incoming slugs are bled out through the perforations in flow tube 11. Another portion of the slugs are reflected from wall 2 back through the media to meet the incoming slugs at the gap end of the chamber. If the effective acoustical length of the chamber is approximately one-quarter of the frequency of the slugs of the incoming stream, the reflected pulses are out of phase with the slug pulsations of the incoming stream and the action of the chamber is to attenuate the magnitude of the slug pressures. The favorable time delay in the arrival of the reflected pulsation due to the flow resistance of the media makes it possible to achieve the desired attenuation with a shorter chamber.

Actually, the flowing gas system as the stream flows into the snubber usually includes a mixture of potentially noisy vibrating systems in addition to the succession of slugs. These systems, being exposed to the acoustical impedance of the media as the gases pass through the snubber, are greatly attenuated. The overall result is a relatively smoothly flowing stream of gases with minimal potential for noise flowing from the outlet 10 of the unit.

The action described is greatly compromised by the presence of liquid in the media since the liquid to the extent present interferes with the passage of the gases through the media. Although the major part of the entrained liquid is removed by the action in the separating chamber 5, very fine particles are carried along into the snubber chamber. While the mesh layers 15 serve to confine the media to the space within chamber 16, an important function of the mesh when the apparatus is employed to treat the discharge of a wet vacuum pump is protection of the media from loss of effectiveness due to the accumulation of the liquid in it. The mesh serves to coalesce the fine particles and provide surfaces along which the liquid may flow to the area of gap 12 where the liquid may be re-entrained by the gas stream and carried out of the unit. If such re-entrainment is undesirable for particular applications, one or more openings 4*a* may be provided in partition 4 to permit any accumulation of liquid to drain down into the separating chamber.

I claim:

1. In a noise attenuating snubber including means forming an elongated enclosure having an inlet and an outlet, a gas flow tube arranged lengthwise within said enclosure for the passage of a pulsating gas stream therethrough, said tube having perforations therein throughout substantially the entire length thereof and extending from the outlet end toward but stopping short of the inlet end of said enclosure to provide a gap opening to extending from said inlet to said outlet of said enclosure and between said enclosure and an acoustic surge chamber said tube, the improvement which comprises the provision of acoustically penetrable media arranged within and filling the surge chamber, said chamber being closed except for the perforations in the flow tube and the gap opening thereinto, the arrangement being such that the portion of the gases of the pulses which expand into the surge chamber through said gap flow into or through said media before discharge from the snubber.

2. Structure in accordance with claim 1 wherein the acoustically penetrable media comprises glass fibers packed to a density of from 5 to 15 pounds per cubic foot.

3. Structure in accordance with claim 1 wherein the acoustically penetrable media comprises glass fibers packed to a density of approximately 10.5 pounds per cubic foot.

4. Structure in accordance with claim 1 wherein the elongated enclosure and gas flow tube are vertically disposed and including a layer of wire mesh upon and extending the length of the gas flow tube and spanning the gap at the inlet end of said tube.

5. Structure in accordance with claim 1 adapted for the handling of pulsating gas streams having fine particles of liquid entrained therewith and wherein the elongated enclosure is vertically disposed and including means for separating out the larger liquid particles from the gases prior to entry into the snubber, said tube having a covering of wire mesh which also spans the gap at the inlet end of said tube to intercept and coalesce fine particles of liquid carried by gases passing through said mesh into the media, the bottom wall of the elongated enclosure having a drain hole therein for the escape of liquid from the surge chamber.

* * * * *

UNITED STATES PATENT OFFICE

CERTIFICATE OF CORRECTION

Patent No. 3,941,206 Dated March 2, 1976

Inventor(s) Edmund John Halter

It is certified that error appears in the above-identified patent and that said Letters Patent are hereby corrected as shown below:

| | |
|---|---|
| Col. 1, line 60 | "statisfactory" should read --satisfactory-- |
| Col. 4, line 2 | after "opening to" delete "extending from said inlet to said outlet of said enclosure and between said enclosure and an acoustic surge chamber" and insert --an acoustic surge chamber extending from said inlet to said outlet of said enclosure and between said enclosure and-- |

Signed and Sealed this

Fourteenth Day of September 1976

[SEAL]

*Attest:*

RUTH C. MASON
*Attesting Officer*

C. MARSHALL DANN
*Commissioner of Patents and Trademarks*